United States Patent [19]

Slaughter

[11] Patent Number: 4,494,310

[45] Date of Patent: Jan. 22, 1985

[54] BELT BUCKLE KNIFE

[75] Inventor: Richard L. Slaughter, Texarkana, Ark.

[73] Assignee: Slaughter Knife Co., Inc., Texarkana, Tex.

[21] Appl. No.: 417,344

[22] Filed: Sep. 13, 1982

[51] Int. Cl.[3] ..... B26B 1/04; B26B 11/00; B26B 29/02

[52] U.S. Cl. ..... 30/155; 30/151; 30/156; 30/157

[58] Field of Search ..... 30/151, 153, 154, 155, 30/156, 158, 295; 224/163

[56] References Cited

U.S. PATENT DOCUMENTS

| | | | |
|---|---|---|---|
| 1,513,861 | 11/1924 | Rieger | 30/151 |
| 1,947,751 | 2/1934 | Witter | 30/156 |
| 2,134,973 | 11/1938 | Harwell | 30/156 |
| 2,265,775 | 12/1941 | McNamara | 30/156 |
| 2,599,439 | 6/1952 | Drake | 30/151 |
| 4,161,818 | 7/1979 | Phelps | 30/157 |
| 4,389,775 | 6/1983 | Collins | 30/156 |

*Primary Examiner*—Paul A. Bell
*Assistant Examiner*—Paul M. Heyrana, Sr.
*Attorney, Agent, or Firm*—Arnold, White & Durkee

[57] ABSTRACT

A belt buckle knife is disclosed in which a knife portion can be removed with the knife blade locked in its open position without the need of removing the belt buckle knife from the belt. The belt buckle knife includes a buckle portion which engages and fastens the belt independent of the knife portion. The knife portion is selectively operable from a knife closed position to a knife open position. In the knife closed position, the knife blade is engaged by an open tapered groove running along the length of the buckle portion, with the knife portion and the buckle portion being securely fastened together. In the knife open position, the knife blade is locked open with respect to the knife handle, and the knife portion can readily be removed from the buckle portion.

5 Claims, 3 Drawing Figures

FIG. 3
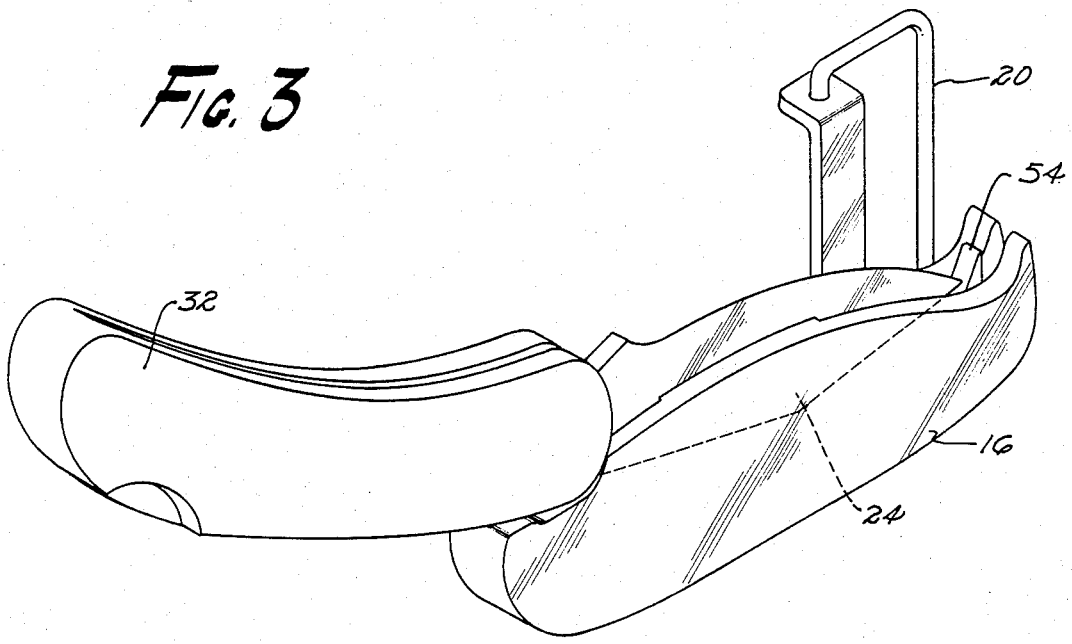
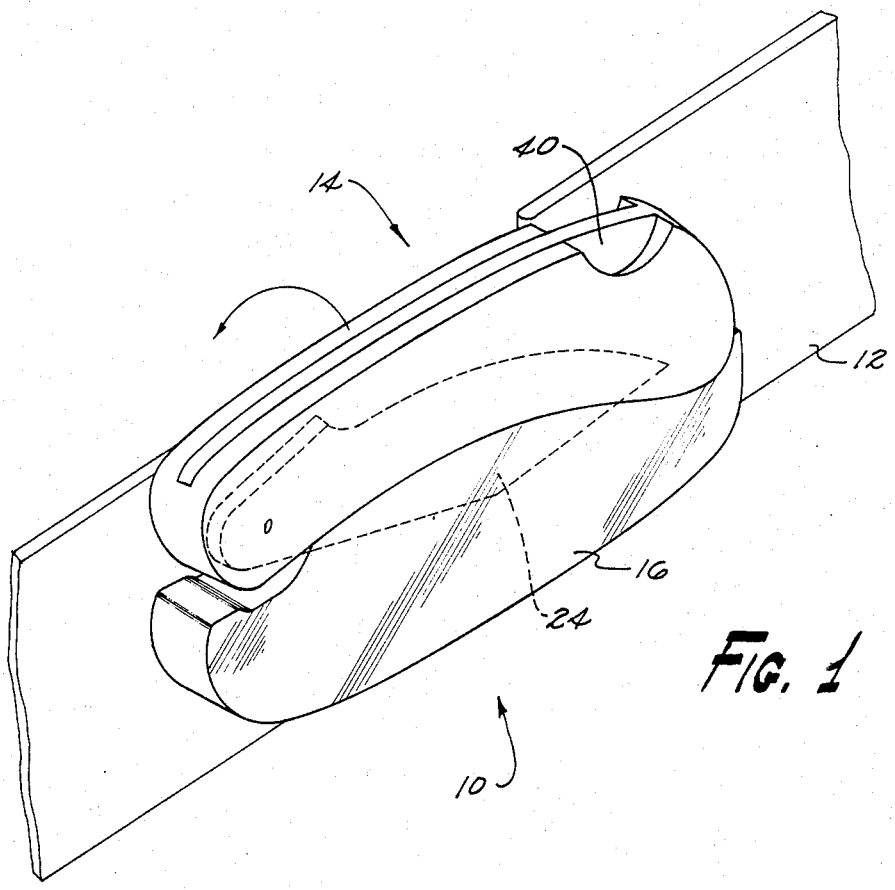
FIG. 1

BELT BUCKLE KNIFE

BACKGROUND OF THE INVENTION

This invention relates generally to knives, and more particularly to a belt buckle and knife combination.

The knife is a tool long used and known by man. It is a favored tool of outdoorsmen, and is used for many tasks, both in and out-of-doors.

Numerous knives have been designed to accommodate varying needs and tastes. Long known is the straight knife which can be accommodated by a sheath worn on a belt. The straight knife has the advantage of being in an open position when withdrawn from its sheath. It has the disadvantage, however, of catching on to underbrush, tree branches and the like in the woods, and of getting in the way when its wearer is seated, for example, in a car.

Folding knives have been designed which can be carried either in a pocket or in a knife case worn on a belt. While roughly half the size of a straight knife when in its closed position, the folding knife can result in a rather large mass in a pocket, which can lead to discomfort when seated. And, while the belt worn knife case is smaller than the belt worn straight knife sheath, it is still of sufficient size to catch underbrush and branches in the woods. The folding knife has the disadvantage of being closed when it is removed from a pocket or from a knife case, thereby requiring an operation in addition to withdrawing the knife from the pocket or knife case to place the knife blade in an open and usable position.

Belt buckle knives have been developed to alleviate the foregoing problems experienced with straight blade knives and folding knives. In most of the known prior art belt buckle knives, however, the knife forms an essential part of the buckle. To use the knife, the belt must first be unfastened and the buckle/knife combination then taken apart. Such prior art devices have the distinct disadvantage that the buckle and belt must be unfastened to use the knife portion of the combination belt buckle/knife.

Other known prior art devices include a belt buckle member and a knife member. The belt buckle member fastens the belt and maintains the belt in the fastened position, even after the knife member is removed. In such known devices, however, the knife member is of the folding knife variety and must be opened by a separate operation after the knife member is removed from the belt buckle member.

Thus there is a need for a belt buckle knife in which a knife member is removed with its blade in an open, locked position, and in which the buckle portion maintains the belt in its fastened, secured position, even after the knife portion is removed. Applicant in copending application Serial No. 389,620, filed June 18, 1982, has provided one version of belt buckle knife. After continued study of the needs of sportsmen, Applicant has devised an improved belt buckle knife which is in some instances easier to manipulate than the previously described embodiments. By this application, the inventor also provides a belt buckle knife combination which can accommodate many of the commercially available folding knives currently on the market.

SUMMARY OF THE INVENTION

According to the present invention, a belt buckle knife is provided. Specifically, the present invention provides a belt buckle knife having a buckle structure which engages and fastens a belt, and a knife structure removably accommodated by the buckle structure. The buckle and knife structures cooperate with each other so that when the knife structure is in a closed position, the knife structure and buckle structure are firmly secured to each other; and when the knife structure is in an open position, it can be removed from the buckle structure with the knife blade locked in an open position.

According to one aspect of the invention, the knife structure is provided a blade member and a handle member. The blade member is provided with a blade portion and a tang portion having a blade member recess. The handle member is provided with a locking arm having a detent. The detent engages the blade member recess to lock the blade member in its open position. When in the folded closed position, the blade portion is partially exposed along its length relative to the handle member.

According to another aspect of the invention, the buckle structure includes a blade receiving groove. When the knife structure is in its closed or open position, the blade receiving groove engages the blade member securely fastening the knife structure and the buckle structure together. To complete the belt buckle knife ensemble, the handle member is unlocked and folded over the blade member.

BRIEF DESCRIPTION OF THE DRAWINGS

The invention will further be described by reference to the accompanying drawings which illustrate a particular embodiment of a belt buckle knife in accordance with the present invention, wherein like members bear like reference numerals and wherein:

FIG. 1 is a perspective view of a belt buckle knife in accordance with the present invention;

FIG. 3 is a perspective view of the knife portion engaged with the buckle portion illustrated in FIG. 1 with the knife blade locked in its open position.

DESCRIPTION OF THE PREFERRED EMBODIMENT

Figure 2:
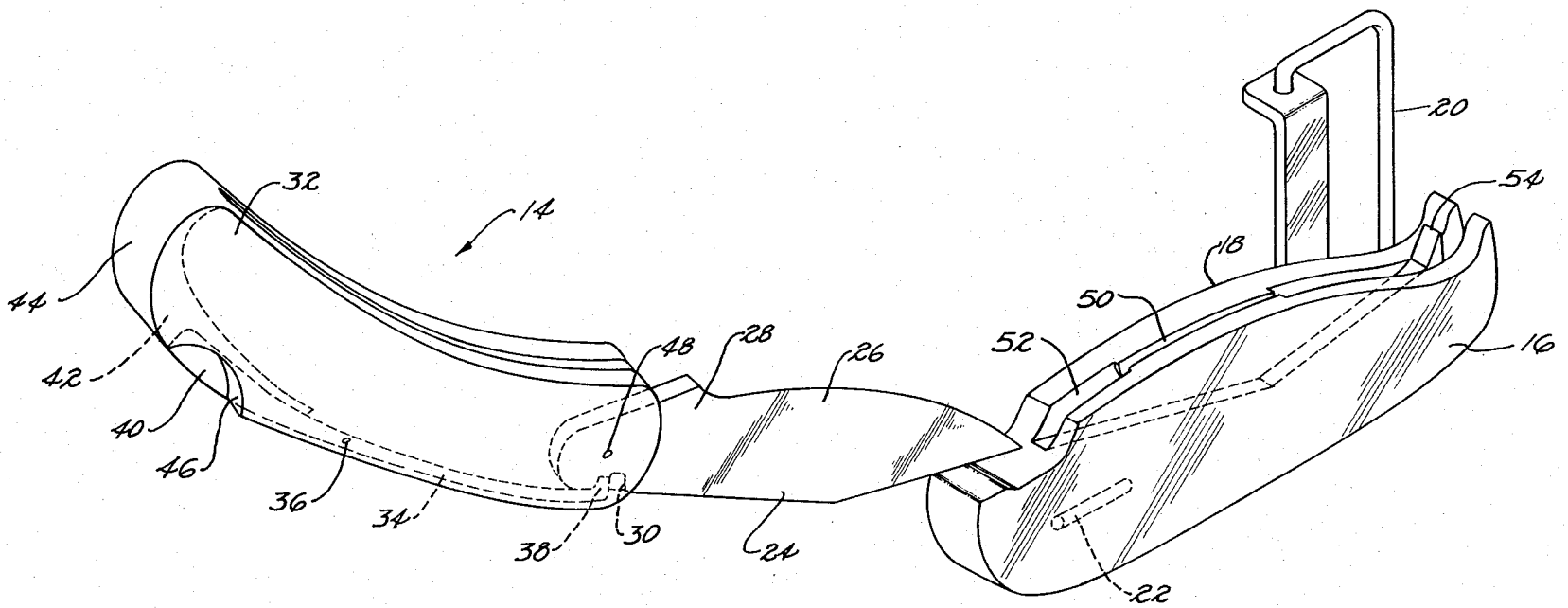
FIG. 2 is a perspective view of the independent knife portion and the independent buckle portion of the belt buckle knife illustrated in FIG. 1.

Referring now to the drawings, and in particular to FIG. 1, there is shown in perspective view a belt buckle knife 10 attached to a belt 12. The belt buckle knife 10 includes a knife structure 14 and a buckle portion 16. In the embodiment illustrated, the knife portion 14 is the upper portion of the belt buckle knife 10, and the buckle portion 16 is the lower portion. The relative location of one portion with respect to the other, however, is not critical.

Referring now to FIGS. 1 and 2, the buckle portion 16 includes a rear flat face 18 on which a belt receiving loop 20 and a belt hook 22 are disposed. The belt receiving loop 20 accommodates the conventional buckle end of the belt 12. To close and fasten the belt, the belt hook 22 is made to engage one of the conventional apertures included on the belt 12. Thus the buckle portion 16 of the belt buckle knife 10 performs all the functions typically performed by a conventional belt buckle.

Referring to FIG. 2, the knife portion 14 includes a blade member 26 having a blunted blade shank 24 and a tang portion 28. The tang portion 28 includes a blade member recess 30. The knife portion can be any conventional folding knife, which when folded has a portion of the blade member partially exposed along its length.

With continued reference to FIG. 2, the knife portion 14 further includes a handle member 32 having a locking arm 34 pivotally mounted on a pivot pin 36. The locking arm includes a detent 38 disposed at one end of the locking arm 34, and a thumb depressing region 40 located at the other end. A bias spring 42 mounted in a handle butt 44 urges the locking member 34 pivotally about the pivot pin 36. Pressure applied at the thumb depressing region 40 of the locking arm 34 tends to overcome the biasing force of the bias spring 42. The handle member 32 includes a thumb recess 46 to facilitate depressing the thumb depression region 40.

The handle member 32 further inclues a pivot pin 48 on which the blade member 26 is mounted. When the blade member 26 is in the locked open position illustrated in FIG. 2, the detent 38 of the locking arm 34 engages the blade member recess 30. The detent 38 is urged into and maintained in engagement with the recess 30 by the biasing force exerted by the biasing spring 42. To unlock the blade, the thumb depressing region 40 of the locking arm 34 is depressed, thereby causing the detent 38 to pivot out of engagement with the blade member recess 30.

FIG. 1 illustrates the knife portion 14 in a closed position with the knife portion 14 and the buckle portion 16 locked together. Referring to FIGS. 1, 2 and 3, the buckle portion 16 includes a blade receiving groove 50 which engages and secures the blade shank 24. The receiving groove 50 runs along substantially the entire length of the top segment of the buckle portion 16. The receiving groove is generally tapered, having a wider opening 52 at the proximal end of the buckle portion 16 so as to accommodate the generally blunt tang portion 28. Moreover the bottom of the receiving groove 50 is wider than the mouth so as to conform with the taper of the blade shank 24.

Also included at the distal end of the receiving groove 50 is a tip projection 54. The tip projection 54 prevents the inserted blade member 26 from advancing beyond the length of the receiving groove 50.

When in the closed locked position, the blade shank 24 of the knife portion 14 engages the tapered blade receiving groove 50 of the buckle portion 16, the handle member 32 folds over in conformance with the top edge of the buckle portion 16 to complete the belt buckle knife ensemble 10.

In operation, the belt buckle knife 10 engages and fastens the belt 12 about the wearer's waist. To remove the knife portion 14 from the belt buckle knife 10, the wearer pivots the handle member 32 in the direction of the arrow illustrated in FIG. 1. With the blade member 26 still engaged by the blade receiving groove 50 of the buckle portion 16, the handle member 32 pivots about the pivot pin 48. As the blade member 26 and the handle member 32 approach the open position illustrated in FIG. 3, the detent 38 of the locking arm 34 slides over a rounded portion tang portion 28 and into engagement with the blade member recess 30. The knife portion 14 is now in its locked open position with the blade shank 24 still engaged by the blade receiving groove 50 of the buckle portion 16. The blade member 26 is then withdrawn laterally from the blade receiving groove 50, separating the knife portion 14 from the buckle portion 16, with the blade member 26 locked in its open position.

As will be apparent to those skilled in the art, the biasing spring 42 need not be a leaf spring as illustrated, but can comprise any suitable biasing element.

The principles, preferred embodiment and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A belt buckle knife adapted to engage and fasten a belt, comprising:

a knife structure having a blade member comprising a blunt edge and sharp edge, and a handle member operable between a knife closed position and a knife open position in which said blade member and said handle member are locked relative to each other, and when in the closed position the sharp edge of the blade member is enclosed by the handle member and a portion of the blunt edge is exposed along its length, and a buckle structure adapted to engage and fasten a belt, the buckle structure engaging the exposed blunt edge of the blade member to fasten the knife structure and buckle structure together.

2. The belt buckle knife according to claim 1 wherein:

the knife structure when securely attached to buckle structure is operable in a knife open position in which the blade member is locked open relative to the handle member and the knife structure is removable from the buckle structure.

3. The belt buckle knife according to claim 1 wherein the buckle structure comprises:

a receiving groove formed by the side walls of the buckle structure along the length of the buckle structure, said groove adapted to engage the blade member along the length of the exposed blunt edge to fasten the knife structure together with the buckle structure.

4. The belt buckle knife according to claim 3 wherein the receiving groove is tapered, said groove widening as it extends into said buckle structure.

5. The belt buckle knife according to claim 1 wherein the knife structure is a conventional folding knife, which when folded has a partially exposed blade member.

* * * * *